US007525505B2

(12) United States Patent
Cislo

(10) Patent No.: US 7,525,505 B2
(45) Date of Patent: Apr. 28, 2009

(54) ANTENNA COVER

(75) Inventor: Donald Cislo, Glendale Heights, IL (US)

(73) Assignee: Antenex, Inc., Glendale Heights, IL (US)

( * ) Notice: Subject to any disclaimer, the term of this patent is extended or adjusted under 35 U.S.C. 154(b) by 387 days.

(21) Appl. No.: 11/520,950

(22) Filed: Sep. 13, 2006

(65) Prior Publication Data

US 2008/0062067 A1 Mar. 13, 2008

(51) Int. Cl.
*H01Q 1/42* (2006.01)

(52) U.S. Cl. ..... 343/872

(58) Field of Classification Search ..... 343/872, 343/702, 895, 786

See application file for complete search history.

(56) References Cited

U.S. PATENT DOCUMENTS

| | | | | |
|---|---|---|---|---|
| 2,493,787 | A | | 1/1950 | Torretti |
| 2,558,763 | A | | 7/1951 | Lee |
| 2,886,814 | A | | 5/1959 | Williams |
| 3,249,945 | A | | 5/1966 | Lewis |
| 4,218,684 | A | | 8/1980 | Northcutt |
| 4,625,213 | A | | 11/1986 | Horn |
| 4,632,354 | A | | 12/1986 | Ascuitto |
| 4,872,017 | A | | 10/1989 | White |
| 4,882,591 | A | | 11/1989 | Galvin et al. |
| D320,603 | S | | 10/1991 | Jones |
| 5,229,784 | A | | 7/1993 | Jones |
| 5,300,940 | A | * | 4/1994 | Simmons ..... 343/749 |
| 5,507,012 | A | * | 4/1996 | Luxon et al. ..... 455/575.5 |
| D373,769 | S | | 9/1996 | Whitehouse |
| 5,600,334 | A | | 2/1997 | Whitehouse |
| 5,650,790 | A | * | 7/1997 | Fukuchi et al. ..... 343/702 |
| 5,836,072 | A | | 11/1998 | Sullivan et al. |
| 5,914,689 | A | * | 6/1999 | Cockson ..... 343/702 |
| 6,166,707 | A | * | 12/2000 | Painter et al. ..... 343/872 |
| 6,469,678 | B1 | | 10/2002 | Pullen |
| 6,593,899 | B2 | * | 7/2003 | Ha et al. ..... 343/895 |
| 2004/0189543 | A1 | | 9/2004 | Jordan et al. |

* cited by examiner

*Primary Examiner*—Huedung Mancuso
(74) *Attorney, Agent, or Firm*—Harness, Dickey & Pierce, P.L.C.

(57) ABSTRACT

An antenna cover that can be fitted onto an existing antenna spring assembly. The antenna cover is constructed of a flexible and resilient material, with a base layer adapted to wrap around the bottom of an antenna spring assembly, the interior of said base layer defining an attachment aperture, a side wall coupled with the base layer and adapted to cover the spring section of an antenna spring, and a top portion coupled with the side wall and adapted to cover the top of the antenna spring assembly, the interior of said top portion defining a whip aperture. The antenna cover is fitted onto an existing spring assembly by inserting the spring into one of the cover's apertures and forcing the cover over the spring assembly until the cover is fully in place. Alternatively, some or all of the cover may be composed of heat shrinkable material, so that when the cover is moved into place on the spring assembly, heat is applied to shrink the cover to closely fit the spring assembly.

14 Claims, 7 Drawing Sheets

A-A Section

ANTENNA COVER

TECHNICAL FIELD

The present invention relates to antenna apparatuses and methods. More particularly, the present invention relates to antenna covers and methods for installing them. Even more particularly, the present invention relates to covers for spring assemblies and methods for installing them.

BACKGROUND ART

Spring loaded antenna mounts have been in use for many years. An inherent problem with such mounts is that the helical spring is typically exposed to the elements, which invites corrosion and debris. Corrosion leads not only to a shorter life span of the spring, but changes the electrical properties of the metal, which can change the tuning of the antenna over an extended period of time. Most spring mounted antennas are mounted on vehicles or boats, which subjects the springs to impacts from high velocity debris. Such impacts can damage the finish of the spring, hastening the corrosion process. In addition, debris, dust and water can become lodged in the coils of the spring, interfering with its function, such as causing noise and/or static during transmit or receive operations.

One way to solve these problems is to overmold the spring with a resilient covering, similar to that described in U.S. Pat. No. 5,836,072 (Sullivan) and U.S. Pat. No. 5,229,784 (Jones). Although this is an effective method of protecting a spring, it cannot be universally applied or retrofitted to existing springs. What is needed is an improved resilient cover for antenna springs.

DISCLOSURE OF THE INVENTION

Various embodiments disclosed herein are directed to a resilient cover for a helical coil spring. According to one embodiment, the resilient cover is composed of elastomeric material, in a semi-cylindrical configuration, with apertures at each end. The aperture opposite the antenna whip is narrower than the body of the spring and its base, thus allowing the cover to wrap around the bottom of the base to its underside.

MODES FOR CARRYING OUT THE INVENTION

The detailed description set forth below in connection with the appended drawings is intended as a description of exemplary embodiments and is not intended to represent the only forms in which the embodiments may be constructed and/or utilized. However, it is to be understood that the same or equivalent functions and sequences may be accomplished by different embodiments that are also intended to be encompassed within the spirit and scope of the specification.

According to one embodiment, the resilient cover is composed of elastomeric material, in a semi-cylindrical configuration, with apertures at each end. The aperture opposite the antenna whip is narrower that the body of the spring, or, if so equipped, the spring's base, thus allowing the cover to wrap around the bottom of the spring or the base to its underside. The cover in such an embodiment, therefore, must be made of highly resilient material to be able to stretch over the spring and/or the base and still fit under the spring or base.

In an alternative embodiment, some or all of the cover may be composed of a heat-shrink material, so that when placed over the spring or its base, it can be heated with a standard heat gun and shrunk to tightly fit the contours of the spring, as well as underneath the spring or its base.

Figure 1:
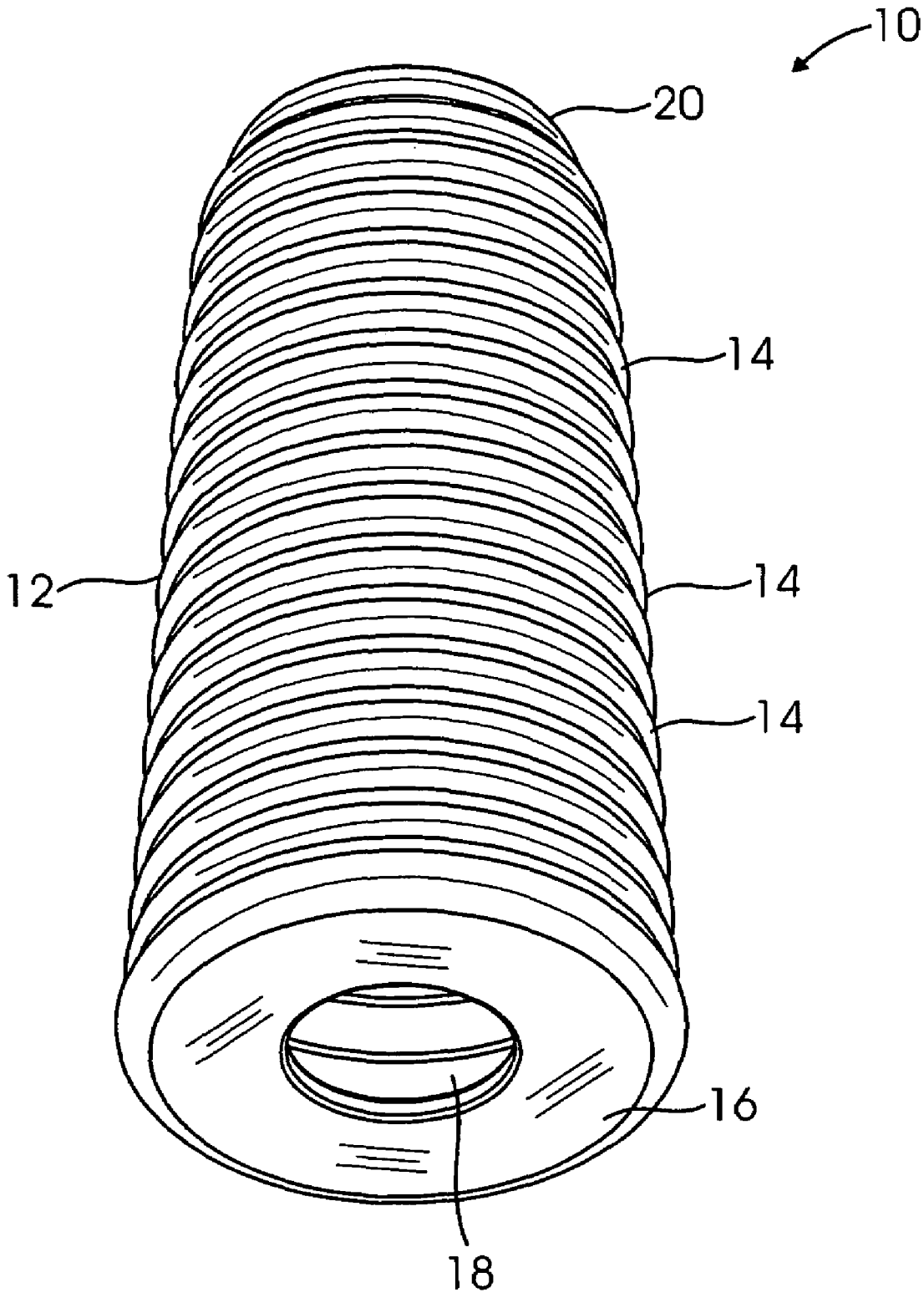
FIG. 1 is a bottom perspective view of an embodiment of the antenna cover.
Figure 2:
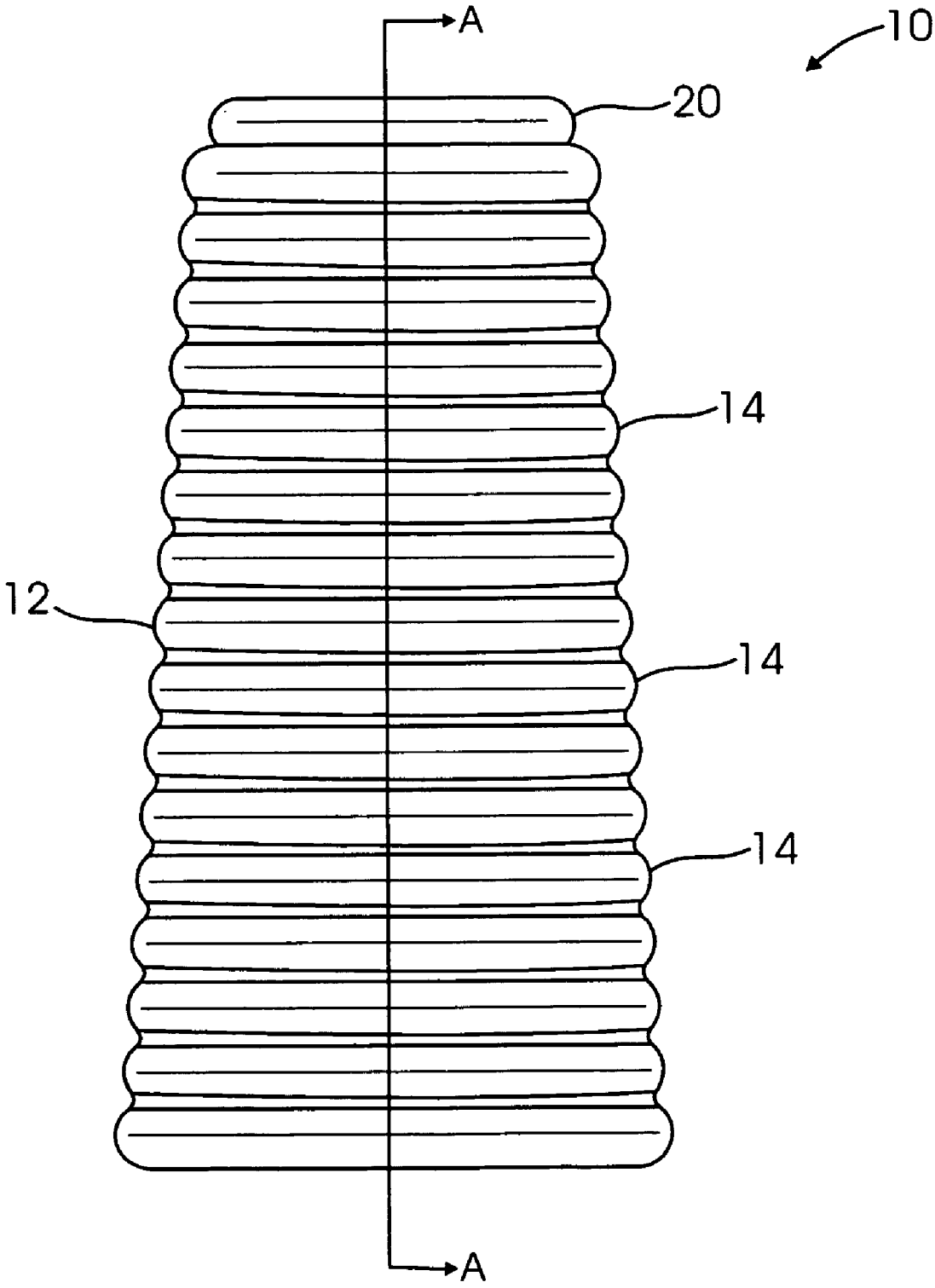
FIG. 2 is a side view thereof showing the cut line for the cross sectional view of FIG. 3.
Figure 3:
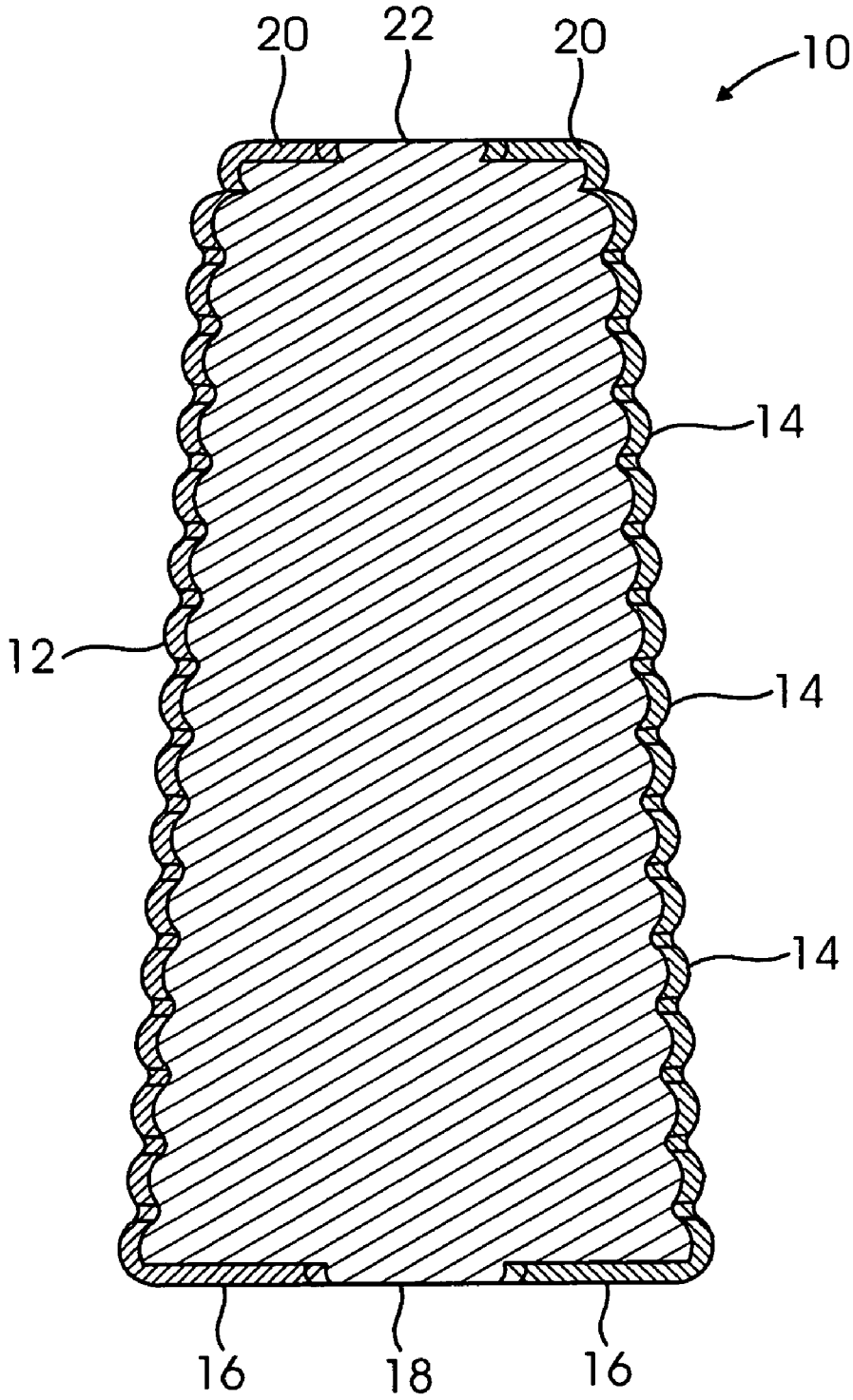
FIG. 3 is a side cross section view thereof, along the cut line shown in FIG. 2.

Turning now to the Figures, FIGS. 1 through 3 show one exemplary embodiment of an antenna cover 10. The interior of the substantially cylindrical side wall 12 generally corresponds to the coils of a helical coil antenna spring, although the side wall 12 may extend beyond such coils in alternate embodiments. The side wall 12 features a series of stacked ribs 14. These ribs 14 are essentially corrugations in the side wall 12, such that the side wall 12 has a substantially uniform thickness at all points.

Alternatively, the ribs 14 could be formed by thicker side wall material at each rib. In such a configuration, the ribs 14 could be either inside or outside the side wall 12, or on both sides. In such configuration with the ribs 14 on just one side, the opposite wall could be smooth or have a corrugated shape.

The ribs 14 and the spaces between them provide a lower bending moment than a straight wall, allowing the side wall 12 to flex more easily. In addition, the ribs 14 provide numerous pre-formed flex points. A straight sided antenna cover would either generally restrict bending, or flex at one or two inherent weak points in the cover, eventually weakening the cover at those points.

In an alternative embodiment, the ribs 14 could be spiraled rather than stacked. The spirals could be matched to the coil of the helical spring, or have a pattern independent of the coils.

Springs, when used for antennas or other masts, are often attached to adapters, which allow the spring to be easily attached to other objects. As used in this patent, a "spring assembly" refers to one or more springs, a top adapter, and a bottom adapter, in any combination, including no adapters. The cover 10 is equipped with a base layer 16 coupled with the side wall 12. When the cover 10 is installed on a spring assembly, the side wall 12 and base layer 16 act together to wrap around the bottom of the spring assembly to provide a virtually complete covering. Such spring assemblies may or may not have a bottom adapter, but the base layer 16 is designed to wrap around or captivate the bottommost portion of the spring assembly. At the interior of the base layer 16 is an attachment aperture 18, which allows an attachment device to pass through the attachment aperture 18 to the spring assembly, so the antenna and/or spring assembly can be attached to a vehicle or other object. When the spring assembly is attached to another object, such as a vehicle or antenna base, the base layer 16 acts as an effective weatherproof seal, keeping liquids or debris from entering either the spring assembly or the object to which it is attached.

In an alternative embodiment, the attachment aperture 18 may be eliminated, so that the base layer 16 completely covers the bottom of the spring assembly. In such a configuration, the base layer 16 may have to be pierced to provide an attachment point with the spring assembly.

Figure 4:
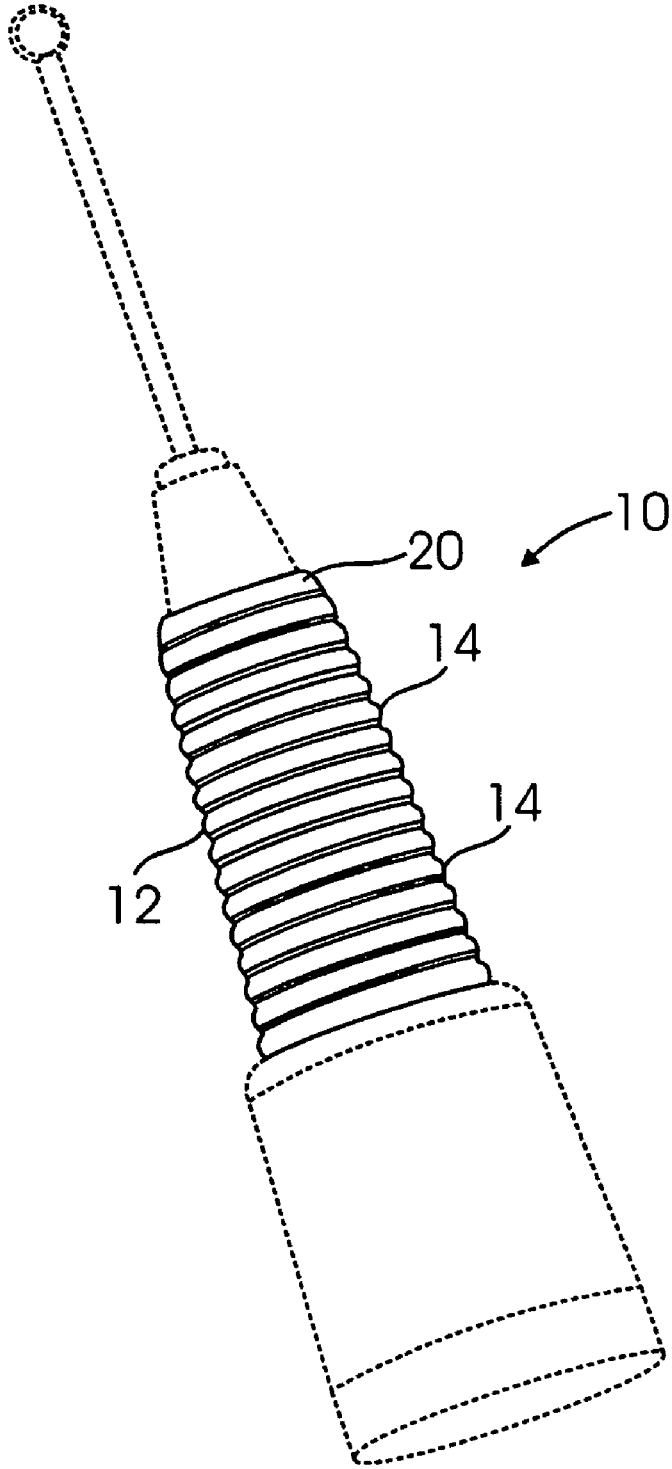
FIG. 4 is a bottom perspective view of an embodiment of the antenna cover installed over a spring assembly, with an antenna whip and base attachment shown in dashed lines.
Figure 5:
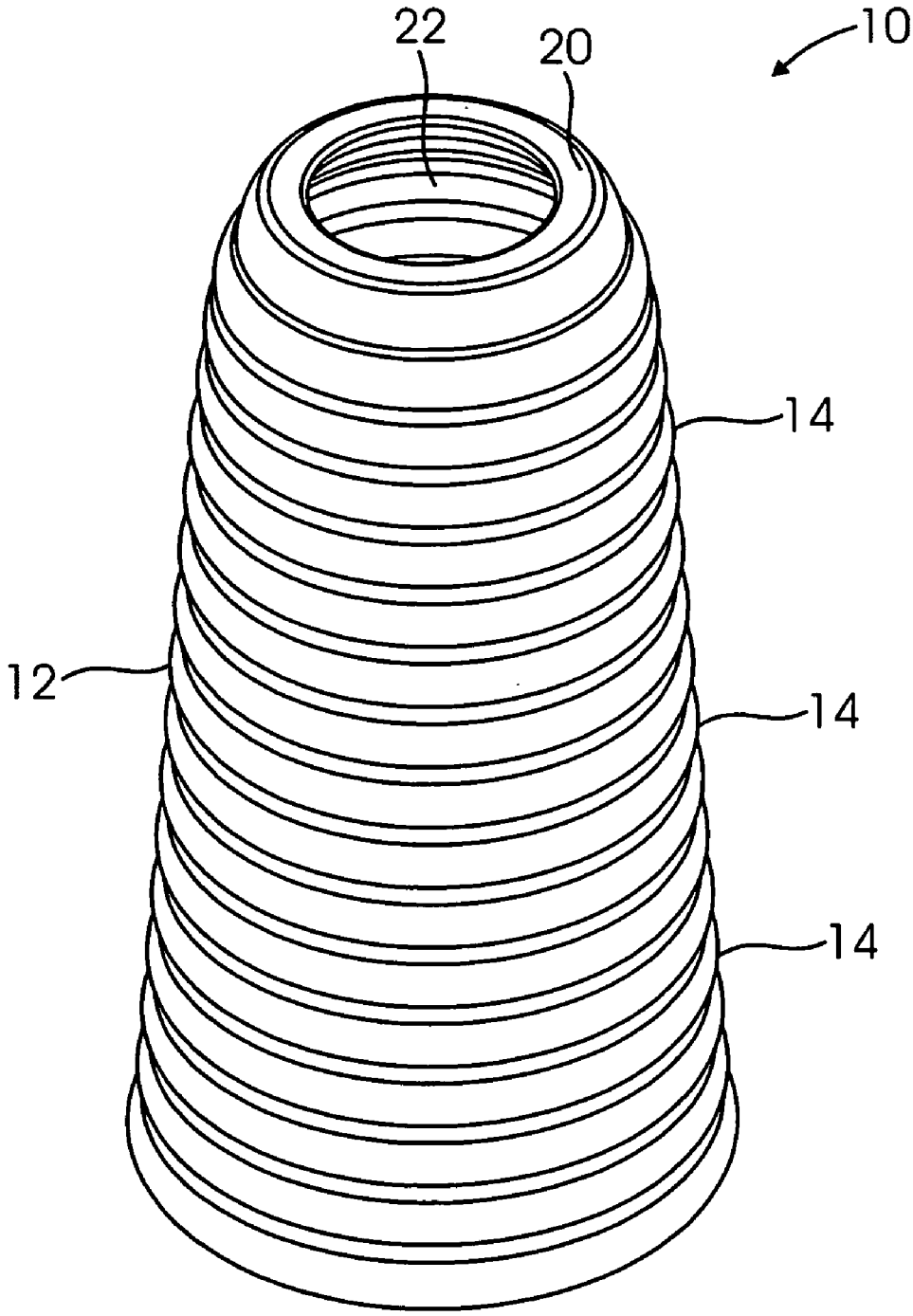
FIG. 5 is a top perspective view of another embodiment of the antenna cover.
Figure 6:
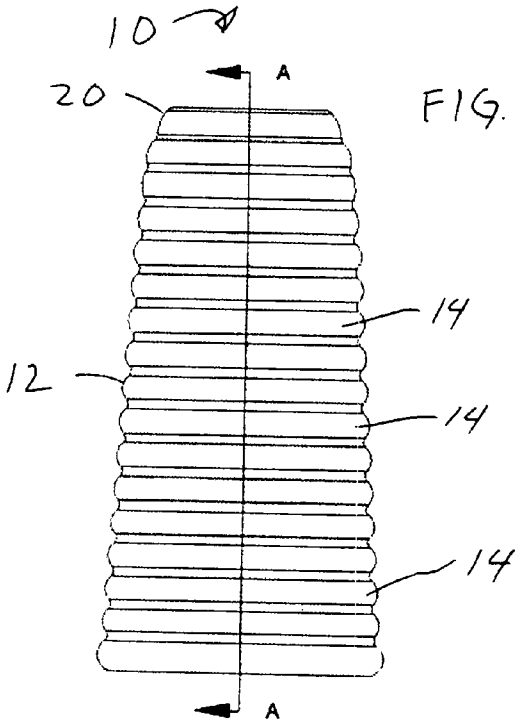
FIG. 6 is a side view thereof showing the cut line for the cross sectional view of FIG. 7.
Figure 8:
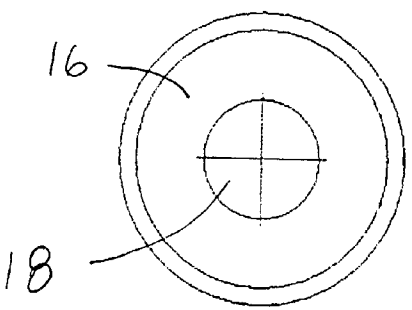
FIG. 8 is a bottom plan view thereof.
Figure 7:
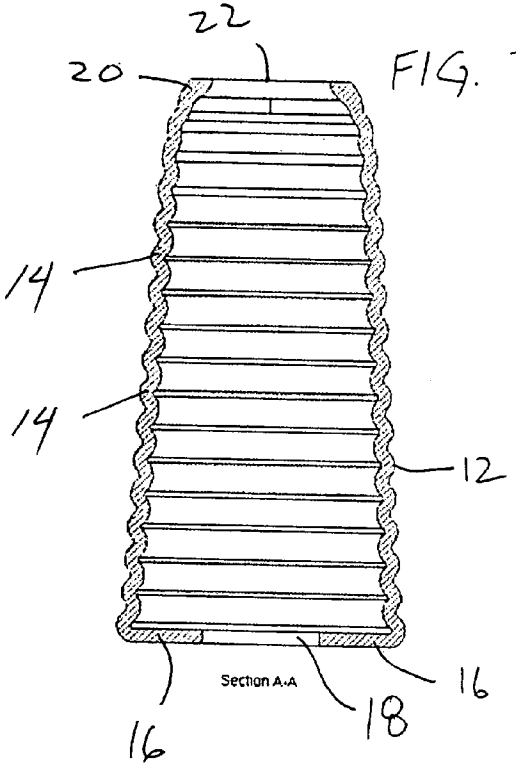
FIG. 7 is a cross section view thereof, along the cut line depicted in FIG. 6.

At the top of the cover 10 is a tapered top portion 20, which is adapted to tightly surround the spring assembly when installed. The interior of the top portion 20 defines a whip aperture 22, to allow the whip of the antenna to protrude beyond the cover 10. As shown in FIG. 4, the whip aperture 22 may be adapted to fit over the topmost spring coil, over which an adapter is fitted to hold the antenna whip, requiring the whip aperture 22 to be adapted to fit whatever attachment mechanism is used to hold the adapter to the spring. Alternatively, the whip aperture 22 may be adapted to fit close to the very top of the antenna spring and/or antenna spring assembly, with an aperture only for the antenna whip. In an alternative embodiment, the cover 10 may have a preformed top section coupled with the whip aperture 22 to completely cover and enclose an antenna whip.

In an alternative embodiment shown in FIGS. 5, 6, 7, and 8, the antenna cover 10 again has a substantially cylindrical sidewall 12, but is tapered in a different manner than the other embodiments disclosed above and as particularly shown in FIGS. 2 and 3, tapering slightly more inward at the top of the cover 10. This embodiment also has ribs 14, a base layer 16, and an attachment aperture 18. In addition to the modified tapering, this embodiment also differs in the top portion 20, which has a larger whip aperture 22 relative to the exterior diameter of the top portion 20. The top portion 20 of this embodiment is designed to fit closely over a spring assembly with a solid top adapter, where the top adapter extends beyond the top portion 20 when installed, although it may be used on a spring assembly with any type of top adapter, or without any such adapter.

Figure 9:
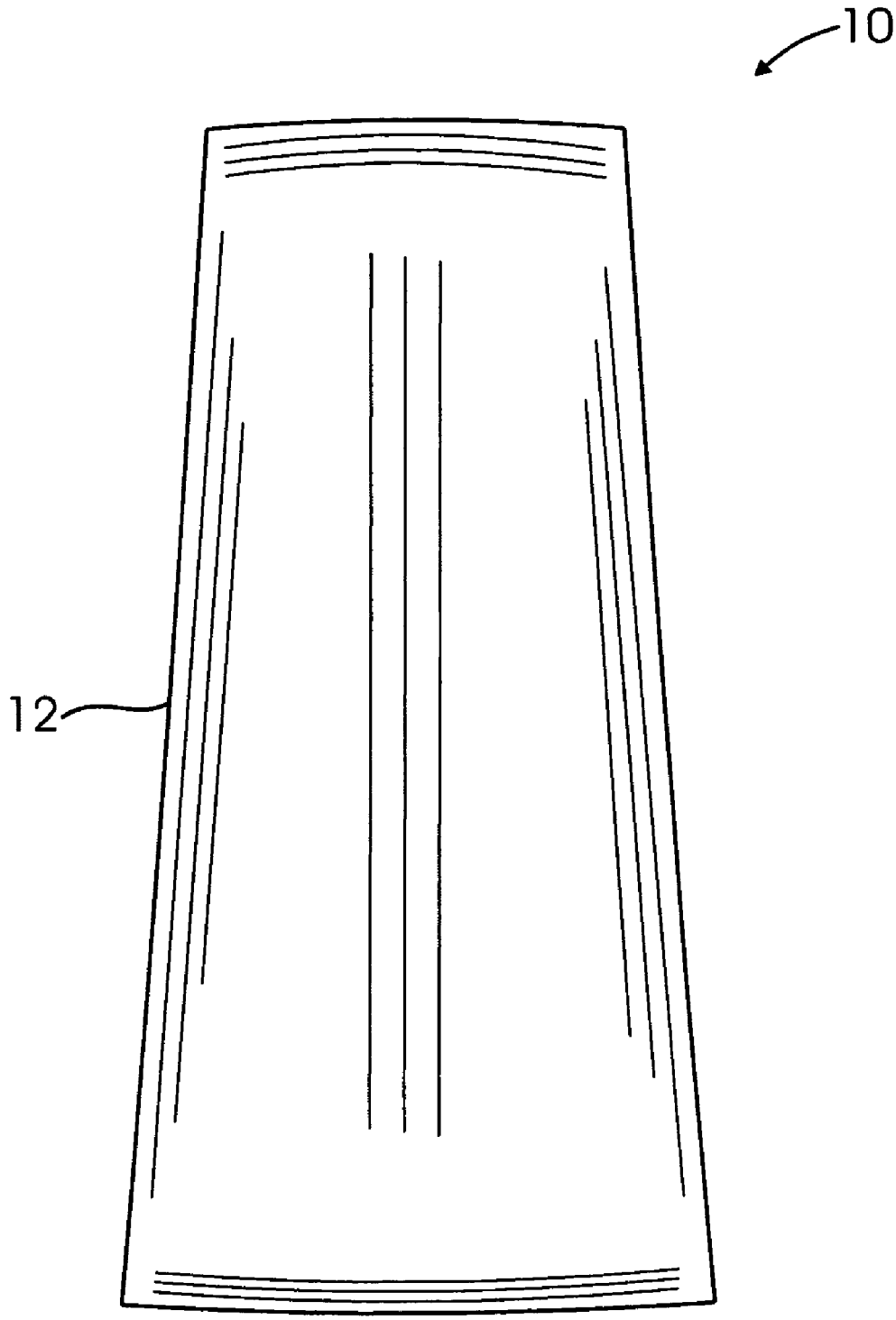
FIG. 9 is a side view of another embodiment of the antenna cover.

Although the ribs 14 provide certain advantages to the antenna cover 10, in alternative embodiments a straight sided cover may be desirable. A straight sided cover may provide some additional bending resistance where needed, and may provide a cleaner airflow over the cover and less noise at high speeds. As shown in FIG. 9, one embodiment of an antenna cover 10 with straight sides may have the same overall shape as the ribbed cover, but with a smooth semi-cylindrical side wall 12, as well as a base layer 16 and top portion 20 (not shown in FIG. 9).

To install one embodiment of the cover 10, the installer inserts the top of the antenna spring assembly into the attachment aperture 18 and forces the cover 10 down over the spring assembly until the base layer 16 clears the bottom of the spring assembly and snaps into place around the bottom of the spring assembly. Alternatively, the installer may install the cover 10 by inserting the bottom of the spring assembly into the whip aperture 22 and forcing the cover up over the spring assembly. In either embodiment, installation may be assisted by the use of an installation guide, preferably comprising a semi-rigid sheath or longitudinal stays that are placed onto the antenna spring prior to installation. The sheath or stays taper as they move away from the antenna spring, so that the cover 10 may be easily placed over such devices. When the cover 10 is pushed onto the spring assembly, the sheath or stays spread and guide the cover 10 over the spring assembly, easing the installation. Such sheath or stays would preferably be removed after installation, but if suitable for the application, they could remain in place.

The antenna cover 10 may be installed on a spring assembly via a number of methods, including slipped on by hand, slipped on via powered tooling, or pressed on via a rotary press. For example, in the hand installation method, the spring assembly may be attached to an antenna housing as a method of fixturing. The antenna cover 10 is inserted through the attachment aperture 18 onto the spring assembly coils and threaded halfway down the spring assembly. The antenna cover 10 is then pulled up just slightly to "unfold" the base layer 16 from beneath the side wall 12, then the antenna cover 10 is threaded the rest of the way down the spring assembly by rotating the antenna cover 10 relative to the spring assembly so that the spring coils thread the cover downward onto the assembly until the antenna cover 10 bottoms out on the fixture. The phrase "rotating the antenna cover 10 relative to the spring assembly" means that either the antenna cover 10, the spring assembly, or both may be rotated. The spring assembly is then pulled some distance away from the fixture, such as by unthreading slightly or by physical separation, and the antenna cover 10 is then pushed down so the base layer 16 captivates the bottom of the spring assembly.

In the power tool assisted assembly, the spring assembly is attached to a fixture, which is coupled with a powered rotational device. The antenna cover 10 is inserted through the attachment aperture 18 onto the rotating spring assembly and threaded about halfway down the assembly. The antenna cover 10 is pulled up just slightly to "unfold" the base layer 16 from beneath the side wall 12, then threaded the rest of the way down the spring assembly until it bottoms out on the fixture. The spring assembly is then unthreaded a few turns from the fixture, and the antenna cover 10 is then pushed down so the base layer 16 captivates the bottom of the spring assembly.

In the automatic press method, the antenna cover 10 is manually fitted into a hard rubber or urethane die, the die being contoured to the outer shape of the guard located along the Z axis. The die is connected by a shaft to a linear power actuator (such as pneumatic, hydraulic or electric) to move die up and down along the Z axis. The spring assembly is placed in a contoured nest to hold the spring assembly in location along the Z axis. The nest is connected by a shaft to a motorized rotational unit rotating around the Z axis. The assembly process begins when the actuator is activated providing a linear motion in the Z axis towards the top of the spring while at the same time the motorized shaft is rotating in a direction that allows the coils of the spring to "screw into" the antenna cover 10. As with the hand installation method, the die holding the antenna cover 10 and the spring assembly rotate relative to each other, meaning that either or both may rotate. The distance of the linear motion applied by the actuator may be set by mechanical or electrical control; such distance will completely slip the antenna cover 10 over the entire spring assembly. The mechanical advantage provided by the press may push the base layer 16 past the bottom of the spring assembly, thus alleviating the step of pulling the antenna cover 10 back up to "unfold" the base layer 16 from beneath the side wall 12. Such an "unfolding" step may, however, be employed with a press. When assembly process is complete the completed assembly is manually removed from the nest.

As those skilled in the art will appreciate, the methods of installation discussed above require that the chosen material for the antenna cover 10 have certain elastic properties. When installing an antenna cover 10 by inserting the top of a spring assembly into attachment aperture 18, the attachment aperture 18 will have to stretch to the diameter of the spring assembly, yet largely return to its original configuration so that the base layer 16 will wrap around the bottom of the spring assembly. Similarly, when installing an antenna cover 10 by inserting the bottom of a spring assembly into the whip aperture 22, the whip aperture 22 will have to stretch to the maximum diameter of the spring assembly and then be able to reduce its size to tightly cover the top of the spring assembly. Obviously, this would be simple if the antenna cover 10 were made of material similar to that of an ordinary balloon. Unfortunately, a balloon lacks the durability to withstand the rigors of the environment in which the antenna cover 10 will operate.

It is possible to use a variety of materials in a single antenna cover 10, such as making the base layer 16 out of a more elastic material while making the sidewall 12 out of a less elastic yet more durable material, but doing so would complicate the manufacturing process and increase the cost. Therefore it is preferable, although not required, to construct the antenna cover 10 out of a single material possessing the elasticity and durability properties discussed above.

One suitable material for the antenna cover 10 is thermoplastic polyurethane, such as polyether-based Desmopan® DP 6065A Polyurethane resin. Although this is a preferred material, any suitable material could be used, and numerous suitable plastics are well known in the art. The material chosen should have the proper flexibility for the application, as well as the installation technique, withstand appropriate environments such as heat, cold, and ultraviolet radiation, and have sufficient durability to withstand vehicle mounting. The antenna cover 10 is preferably formed by injection molding, although extrusion or blow molding may be used.

It may be beneficial to use a material that has greater elasticity at elevated temperatures. With such a material, the installer may heat the antenna cover 10, and if possible the spring assembly, and quickly install the antenna cover 10 using heat resistant gloves and/or tools. Heating could be accomplished in a variety of methods, such as using an oven, a heat gun, or hot water. A material that needs no such heating, however, would yield an antenna cover 10 that is more easily installed in a variety of environments and by a wider variety of installers.

In several of the embodiments disclosed herein, the resilient, flexible, and durable material of the cover must allow the cover to be installed over an existing spring assembly. Accordingly, the cover should not be too thick or it will be difficult to install and have insufficient flexibility during operation, nor too thin as it may not withstand either installation or subsequent use. In one embodiment, the material used for the cover 10 has an average thickness of between approximately 0.020 inches and approximately 0.100 inches. In another embodiment, that range is between approximately 0.035 inches and approximately 0.065 inches. In yet another embodiment the material used for the cover 10 has an average thickness of between approximately 0.045 inches and approximately 0.055 inches.

After the cover 10 is installed, and the spring assembly and cover are attached to another object such as a vehicle, the attachment apparatus pulls down on the spring assembly, and the base layer 16 becomes sandwiched between the spring assembly and that object. In order for the base layer 16 to effectively seal out the elements, it must have sufficient areal coverage to act as a "gasket" between the bottom of the spring assembly and the object to which it is attached. In addition, the attachment aperture 18 must be sufficiently large to firmly attach the spring assembly to that object, and withstand the types of forces that may act on it, particularly when attached to a vehicle. Therefore, the ratio of the diameter of the attachment aperture 18 to the diameter of the base layer 16 in most embodiments ranges from approximately 0.20 to approximately 0.80, depending on the size of the spring assembly and the attachment apparatus. In another embodiment, that ratio ranges from approximately 0.35 to approximately 0.55. In a preferred embodiment, the ratio of the diameter of the attachment aperture 18 to the diameter of the base layer 16 ranges from approximately 0.40 to approximately 0.50.

The above measurements and ratios are provided as a reference, and are not intended to restrict the claims or the other embodiments described herein. Other embodiments may have differing measurements and ratios depending on the spring that is used with, or the materials used in, the antenna cover 10. As discussed below, the antenna cover 10 as disclosed herein may be used with a wide variety of spring-type devices of various shapes and configurations. As but one example, the base layer 16 and/or the attachment aperture could have a non-round dimension, and the use of the term "diameter" above is not meant to restrict the claims to only round configurations for those elements, except as expressly set forth in the claims. The above measurements and ratios are intended to be applied only to certain, specific embodiments, and not to all embodiments.

In an alternative embodiment, some or all of the cover 10 may be composed of heat shrinkable material, such as polyolefin, fluoropolymer, fluoroelastomer, elastomer, or other suitable material. In such an embodiment, the cover 10 is installed it over the spring assembly, and heat is applied to shrink the material to closely fit the spring assembly. Such embodiments could be used with both the embodiment having a whip aperture 22, and the embodiment having no such aperture but instead covers and encloses the entire whip with cover material. In one such embodiment, the side wall 12 may be composed of non-heat shrink material, such as polyurethane, and the base layer 16 composed of heat shrink material. Such an embodiment would allow the ribs to be composed of ideal material to withstand the rigors of the environment, while the relatively sheltered base layer 16 is composed of material that is perhaps slightly less robust yet highly shrinkable to tightly adapt to the bottom of the spring assembly. Alternatively, if the heat shrinkable material is environmentally resistant, it may be used just on the top portion 20 of the cover 10, so that the cover 10 can be slid onto the antenna spring through the whip aperture 22 until the base layer 16 is fully seated against the bottom of the spring assembly, and then the top portion 20 is heat shrunk to tightly seal the top portion 20 to the spring assembly.

In another embodiment, the entire cover 10 may be composed of heat shrink material of varying shrinkage rates, with less shrinkage for the rib area, and more shrinkage for the base area to effectively form around the bottom of the spring assembly. In yet another embodiment, the entire cover 10 may be composed of the same type of heat shrinkable material. In either embodiment, the ribs 14 may eliminated, as the material will shrink around the spring coils to form pseudo-ribs. Alternatively, the ribs 14 could be preformed in the heat shrinkable material.

Although the antenna cover 10 described above is largely intended for use with an antenna spring assembly, it may be used with springs of any type, and thus may be more properly be termed "spring cover." The above described embodiments are preferably used with a helical coil spring, whether it is straight, tapered, or has any other shape. However, all such embodiments may be used with other types of springs or flexible support materials, whether used with an antenna or not, without departing from the inventive concepts disclosed herein. Such spring covers could be used with support masts for flags or other devices, or spring supports for virtually any device.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

INDUSTRIAL APPLICABILITY

The present invention industrially applies to antenna apparatuses and methods. More particularly, the present invention industrially applies to antenna covers and methods for installing them. Even more particularly, the present invention industrially applies to covers for spring assemblies and methods for installing them.

What is claimed is:

1. An antenna cover, comprising:

a side wall adapted to cover the spring section of an antenna spring assembly, a base layer having a diameter and coupled with the sidewall, said base layer adapted to wrap around the bottom of an antenna spring assembly, an attachment aperture having a diameter defined by the interior of said base layer, wherein the ratio of the attachment aperture diameter to the base layer diameter is within a range from approximately two-tenths to approximately eight-tenths, a top portion coupled with the side wall and adapted to tightly surround the top of a spring assembly, the interior of said top portion defining a whip aperture, wherein at least the side walls are composed of a resilient, flexible, and durable material having an average thickness within a range from approximately two-hundredths of an inch to approximately one-tenth of an inch.

2. The antenna cover of claim 1, further comprising ribs integrated into the side walls.

3. The antenna cover of claim 2 wherein the ribs are in a stacked configuration.

4. The antenna cover of claim 1 wherein the resilient, flexible, and durable material is comprised of polyurethane.

5. The antenna cover of claim 1, wherein at least a portion of the base layer is comprised of heat shrinkable material.

6. The antenna cover of claim 5, wherein such the heat shrinkable material is designed such that when heat is applied to said base layer it adapts to wrap around the bottom of the spring assembly.

7. The antenna cover of claim 5, wherein the side wall and top portion are also comprised of heat shrinkable material.

8. The antenna cover of claim 7, wherein the base layer, side wall, and top portion have heat shrinkable material that is specifically adapted to shrink to fit the portions of the spring assembly each of those elements is designed to cover.

9. The antenna cover of claim 5, wherein the side wall has ribs.

10. The antenna cover of claim 9, wherein the ribs are corrugations of the side wall and have a stacked configuration.

11. An antenna cover, comprising a substantially cylindrical side wall, adapted to cover at least the spring section of an antenna spring assembly, corrugated ribs integrated into said sidewall, said corrugated ribs having a stacked configuration, a base layer having a diameter and coupled with the sidewall, said base layer adapted to wrap around the bottom of an antenna spring assembly, an attachment aperture having a diameter defined by the interior of said base layer, wherein the ratio of the attachment aperture diameter to the base layer diameter is within a range from approximately thirty-five hundredths to approximately fifty-five hundredths, a top portion coupled with the sidewall, said top portion adapted to tightly surround the top of the antenna spring assembly, and a whip aperture defined by the interior of said top portion, wherein the antenna cover is comprised of a resilient, flexible, and durable material having an average thickness within a range from approximately two-hundredths of an inch to approximately one-tenth of an inch, and when the antenna cover is fully formed it is adapted to be installed over an existing antenna spring assembly.

12. The antenna cover of claim 11 wherein the ratio of the attachment aperture diameter to the base layer diameter is within a range from approximately four tenths to approximately one-half.

13. The antenna cover of claim 11 wherein the average thickness of the cover is within a range from approximately thirty-five hundredths of an inch to approximately sixty-five hundredths of an inch.

14. The antenna cover of claim 13 wherein the average thickness of the cover is within a range from approximately forty-five hundredths of an inch to approximately fifty-five hundredths of an inch.

* * * * *